US009671147B2

(12) United States Patent
Jeong et al.

(10) Patent No.: US 9,671,147 B2
(45) Date of Patent: Jun. 6, 2017

(54) REFRIGERATOR

(71) Applicant: SAMSUNG ELECTRONICS CO., LTD., Suwon-si, Gyeonggi-do (KR)

(72) Inventors: Jin Jeong, Yongin-si (KR); Do Hyung Kim, Suwon-si (KR); Do Yun Jang, Busan (KR); Sang Hyun Park, Seongnam-si (KR); Bong Su Son, Cheonan-si (KR); Byung Suk An, Suwon-si (KR); Qasim Khan, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 277 days.

(21) Appl. No.: 14/281,223

(22) Filed: May 19, 2014

(65) Prior Publication Data

US 2014/0345313 A1 Nov. 27, 2014

(30) Foreign Application Priority Data

May 27, 2013 (KR) ..... 10-2013-0059754

(51) Int. Cl.
*F25C 5/02* (2006.01)
*F25C 5/18* (2006.01)
(Continued)

(52) U.S. Cl.
CPC ..... *F25C 5/02* (2013.01); *F25C 5/005* (2013.01); *F25C 5/046* (2013.01); *F25C 5/182* (2013.01)

(58) Field of Classification Search
CPC .. F25C 5/02; F25C 5/046; F25C 5/005; F25C 5/12
See application file for complete search history.

(56) References Cited

U.S. PATENT DOCUMENTS

2006/0059939 A1* 3/2006 An ..... F25C 5/046 62/344
2010/0257889 A1 10/2010 Lee
(Continued)

FOREIGN PATENT DOCUMENTS

| | | |
|---|---|---|
| EP | 2 339 277 | 6/2011 |
| EP | 2 413 071 | 1/2012 |
| WO | 2008/032986 | 3/2008 |

OTHER PUBLICATIONS

European Search Report issued Mar. 26, 2015 in corresponding European Patent Application No. 14167547.0.
(Continued)

*Primary Examiner* — Elizabeth Martin
(74) *Attorney, Agent, or Firm* — Staas & Halsey LLP

(57) ABSTRACT

A refrigerator includes a body, a storage compartment provided in the body, a door to open and close the storage compartment, an icemaker provided to one side of the storage compartment, an ice bucket provided under the icemaker, and a crusher provided to the rear surface of the door and having an inlet disposed under the outlet of the ice bucket when the door is closed. The crusher may be provided separately from the ice bucket and may independently mounted and detached to and from the rear surface of the door. The ice bucket may have a slimmer design. The space utilization and usability of the storage compartments and the rear surface of the doors may be enhanced.

13 Claims, 8 Drawing Sheets

(51) Int. Cl.
*F25C 5/00* (2006.01)
*F25C 5/04* (2006.01)

(56) References Cited

U.S. PATENT DOCUMENTS

| | | | | |
|---|---|---|---|---|
| 2011/0138837 | A1* | 6/2011 | Chase | F25C 5/005 62/320 |
| 2011/0146335 | A1* | 6/2011 | Jung | F25C 5/005 62/441 |
| 2013/0000345 | A1* | 1/2013 | Vitan | F25C 5/005 62/344 |
| 2013/0105611 | A1 | 5/2013 | Nuss | |

OTHER PUBLICATIONS

European Office Action dated Oct. 6, 2016 from European Patent Application No. 14167547.0, 7 pages.

* cited by examiner

REFRIGERATOR

CROSS-REFERENCE TO RELATED APPLICATIONS

This application claims the benefit of Korean Patent Application No. 10-2013-0059754, filed on May 27, 2013 in the Korean Intellectual Property Office, the disclosure of which is incorporated herein by reference.

BACKGROUND

1. Field

Embodiments of the present disclosure relate to a refrigerator having an icemaker to produce ice, an ice bucket to store ice, and a crusher to crush ice.

2. Description of the Related Art

A refrigerator, a home appliance used to keep food fresh, generally includes a storage compartment to store food and a cold air supply unit to supply cold air. Depending on consumer demand, the refrigerator may be provided with an icemaker to produce ice and an ice bucket to store produced ice. The refrigerator may be further provided with a crusher to crush the ice produced in the icemaker.

The non-crushed ice produced in the icemaker may be stored in the ice bucket, and when necessary, it may be transported to a dispenser provided to the door through a transport unit provided to the ice bucket. While being transported to the dispenser, the non-crushed ice may be crushed into ice fragments through the crusher.

A crusher includes a rotating blade, a fixed blade, a motor to generate rotational force, an opening/closing member to select whether to crush ice, and a solenoid unit to drive the opening/closing member.

Such a conventional crusher has been coupled to an end of a transport unit and arranged in an ice bucket wherein the transport unit is placed. Accordingly, this has led to increase of the size of the ice bucket. Thereby, there has been limit to enhancing space utilization and usability of the storage compartments and the rear surfaces of the doors.

SUMMARY

Therefore, it is an aspect of the present disclosure to provide a refrigerator having a crusher detachably mountable to the rear surface of a door separately from an ice bucket.

It is another aspect of the present disclosure to provide a refrigerator having an ice bucket, the width of which is slimmer than in conventional cases.

It is another aspect of the present disclosure to provide a refrigerator having a storage compartment and a rear surface of a door with enhanced space utilization and usability.

Additional aspects of the disclosure will be set forth in part in the description which follows and, in part, will be apparent from the description, or may be learned by practice of the disclosure.

In accordance with one aspect of the present disclosure, a refrigerator includes a body, a storage compartment provided in the body, a door rotatably coupled to the body to open and close the storage compartment, a dispenser provided to the door to allow water or ice in the storage compartment to be supplied to an exterior of the storage compartment without opening the door, an icemaker provided in the storage compartment to produce ice, an ice bucket provided in the storage compartment to store ice produced by the icemaker, a transport unit provided to the ice bucket to transport the ice stored in the ice bucket toward the dispenser, and a crusher to crush the ice transported by the transport unit and to supply the same to the dispenser, the crusher being provided separately from the ice bucket and the transport unit and mounted to a rear surface of the door.

Herein, the crusher may be detachable from the rear surface of the door.

In addition, the crusher may be mounted to a dyke protruding from the rear surface of the door to allow mounting of a door pocket.

Herein, the dyke may be provided with a fitting groove, and the crusher is provided with a fitting protrusion, wherein the crusher may be mounted to the dyke by fitting the fitting protrusion into the fitting groove.

In addition, the crusher may include a crushing motor to provide driving force to rotate a rotating blade of the crusher, the crushing motor being provided separately from a transport motor to drive the transport unit.

In addition, the crusher may include a case, a rotating blade rotatably provided in the case, a fixed blade fixed to the case, a crushing motor to drive the rotating blade, an inlet allowing the ice to be introduced into the case therethrough, an outlet allowing the ice to be discharged from the case, an opening/closing member to open and close the outlet, and a solenoid unit to drive the opening/closing member.

Herein, the crusher may further include a storage space to store the ice introduced through the inlet, a crushing space to crush the ice, a partition wall to partition the storage space and the crushing space from each other, a communication hole formed in the partition wall to allow the storage space and the crushing space to communicate with each other, and a stirrer to stir the ice in the storage space such that the ice in the storage space moves to the crushing space.

In addition, when the door is closed, the inlet of the crusher may be positioned directly under an outlet of the ice bucket such that the ice bucket communicates with the crusher.

The body may include an outer case, an inner case provided inside the outer case, and an insulation member provided between the outer case and the inner case, wherein the inner case may be provided with an accommodation portion recessed toward the insulation member to accommodate at least one portion of the icemaker. The insulation member may be slimmer in a section having the accommodation portion than in other sections.

Herein, a vacuum insulation member may be provided between the outer case and the accommodation portion of the inner case.

In addition, the inner case may include a top wall, a bottom wall, a rear wall, a plurality of sidewalls, and an intermediate wall, wherein the accommodation portion may be formed at one of the sidewalls and the intermediate wall.

In accordance with another aspect of the present disclosure, a refrigerator includes a body including an outer case, an inner case provided inside the outer case, and an insulation member provided between the outer case and the inner case, a storage compartment provided in the body, a door rotatably coupled to the body to open and close the storage compartment, a dispenser provided to the door to allow water or ice in the storage compartment to be supplied to an exterior of the storage compartment without opening the door, an icemaker provided in the storage compartment to produce ice, an ice bucket provided in the storage compartment to store ice produced by the icemaker, and a transport unit provided to the ice bucket to transport the ice stored in the ice bucket toward the dispenser, wherein the inner case is provided with an accommodation portion recessed toward the insulation member to accommodate at least one portion of the icemaker.

Herein, a distance between the inner case and the outer case is shorter in a section having the accommodation portion than in the other section.

In addition, a vacuum insulation member may be provided between the outer case and the accommodation portion of the inner case.

The inner case may include a top wall, a bottom wall, a rear wall, a plurality of sidewalls, and an intermediate wall, wherein the accommodation portion may be formed at one of the sidewalls and the intermediate wall.

In accordance with a further aspect of the present disclosure, a refrigerator includes a body including an outer case, an inner case provided inside the outer case, and an insulation member provided between the outer case and the inner case, a storage compartment provided in the body, a door rotatably coupled to the body to open and close the storage compartment, a dispenser provided to the door to allow water or ice in the storage compartment to be supplied to an exterior of the storage compartment without opening the door, an icemaker provided in the storage compartment to produce ice, an ice bucket provided in the storage compartment to store ice produced by the icemaker, a transport unit provided to the ice bucket to transport the ice stored in the ice bucket toward the dispenser, and a crusher to crush the ice transported by the transport unit and to supply the same to the dispenser, the crusher being provided separately from the ice bucket and the transport unit and mounted to a rear surface of the door, wherein the inner case may be provided with an accommodation portion recessed toward the insulation member to accommodate at least one portion of the icemaker, wherein the icemaker is arranged such that at least one portion thereof is accommodated in the accommodation portion.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
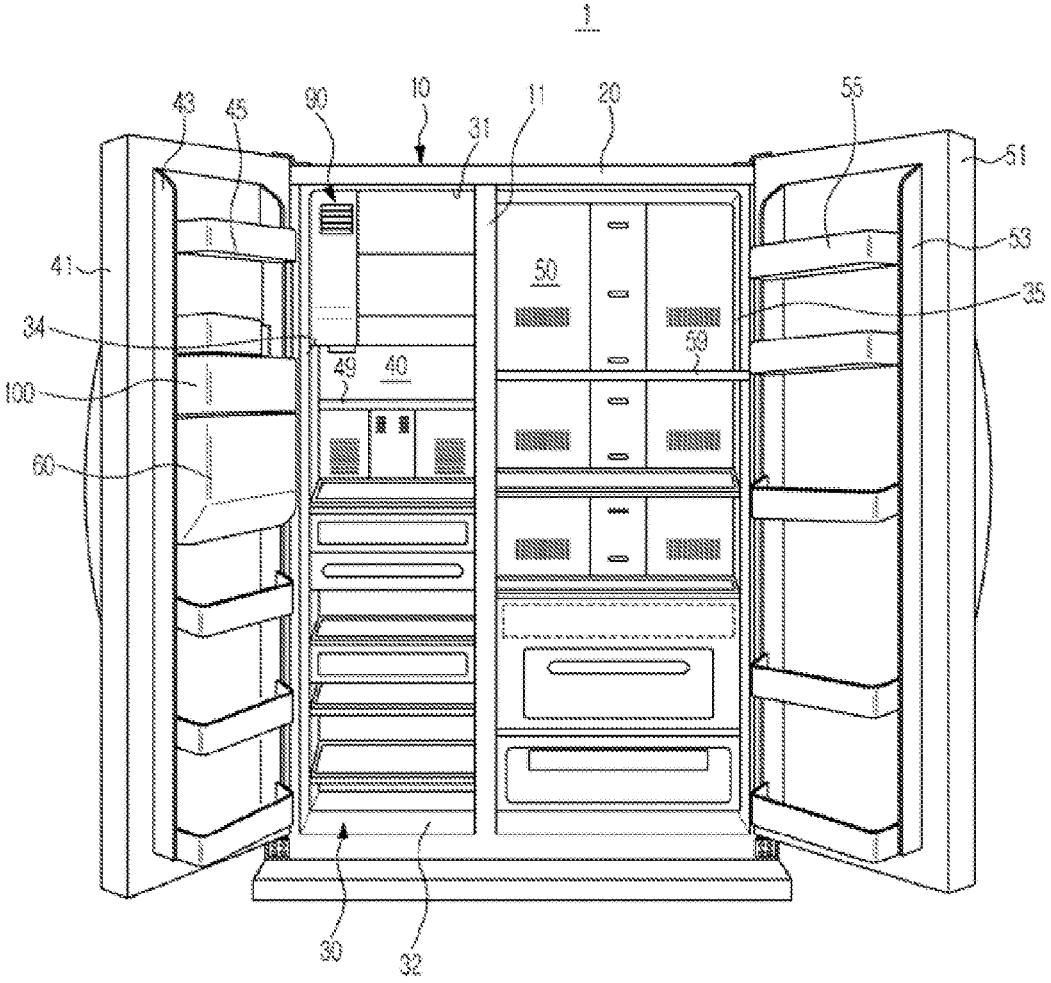
FIG. 1 is a view showing the entire external appearance of a refrigerator according to an exemplary embodiment of the present disclosure.

Reference will now be made in detail to the embodiments of the present disclosure, examples of which are illustrated in the accompanying drawings, wherein like reference numerals refer to like elements throughout.

Figure 2:
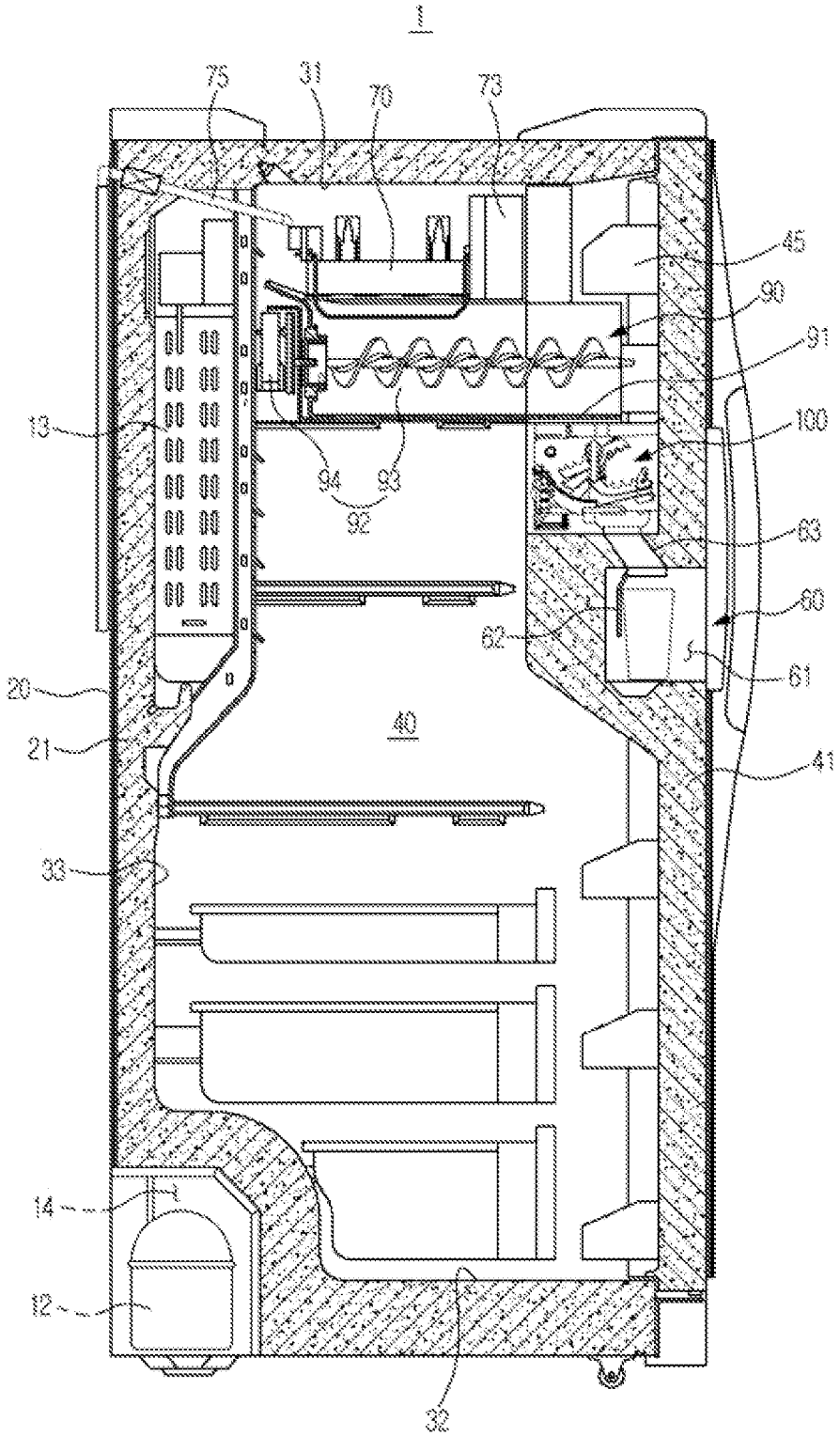
FIG. 2 is a lateral cross-sectional view schematically illustrating the refrigerator of FIG. 1.
Figure 3:
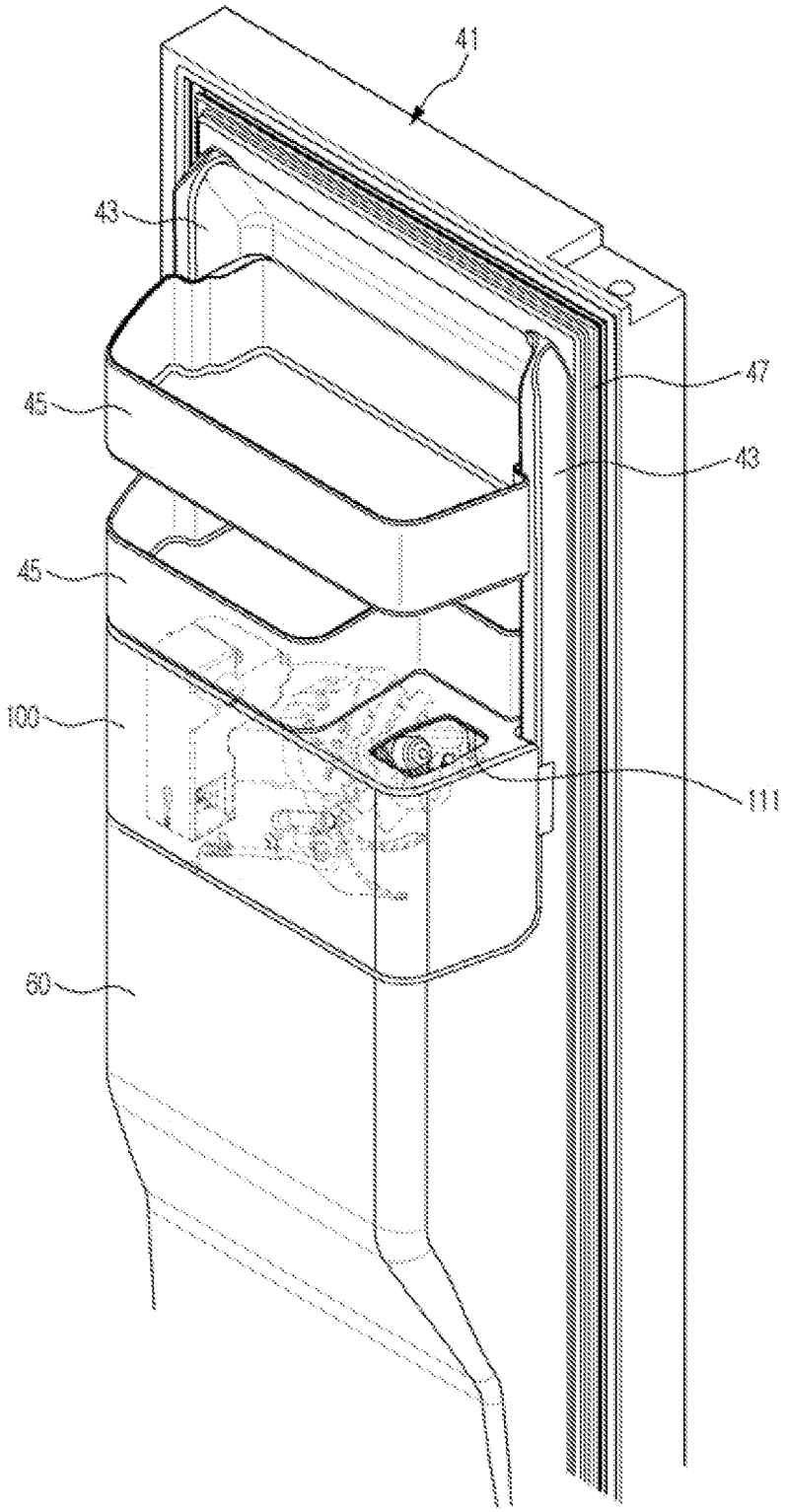
FIG. 3 is a view illustrating the back of a freezer compartment door of the refrigerator of FIG. 1.
Figure 4:
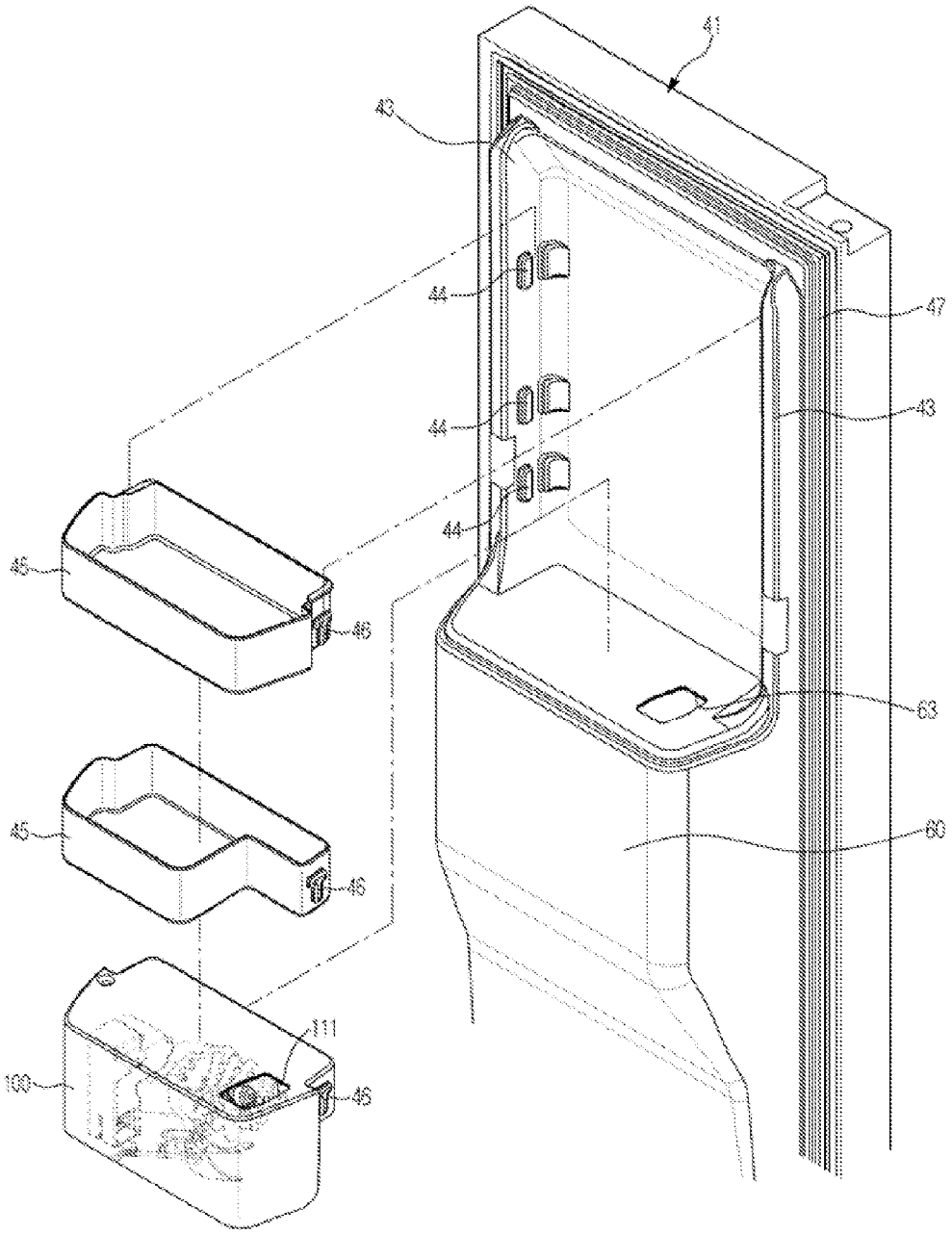
FIG. 4 is a view illustrating coupling of a crusher of the refrigerator of FIG. 1.

FIG. 1 is a view showing the entire external appearance of a refrigerator according to an exemplary embodiment of the present disclosure, and FIG. 2 is a lateral cross-sectional view schematically illustrating the refrigerator of FIG. 1. FIG. 3 is a view illustrating the rear surface of a freezer compartment door of the refrigerator of FIG. 1, and FIG. 4 is a view illustrating coupling of a crusher of the refrigerator of FIG. 1.

Referring to FIGS. 1 to 4, a refrigerator 1 includes a body 10, storage compartments 40 and 50 provided in the body 10, and a cold air supply unit to provide cool air to the storage compartments 40 and 50.

The body 10 includes an outer case 20 forming an external appearance of the body 10, an inner case 30 coupled to an inside part of the outer case 20 to define the storage compartments 40 and 50, and an insulation member 21 provided between the outer case 20 and the inner case 30. The outer case 20 may be formed of a metallic material, and the inner case 30 may be formed of resin material. The insulation member 21 may be foam insulation formed by foaming and hardening an undiluted urethane foam solution.

The inner case 30 may include a top wall 31, sidewalls 34 and 35, a bottom wall 32, and an intermediate wall 11. The intermediate wall 11 may partition the storage compartments 40 and 50 into a freezer compartment 40 and a fresh food compartment 50.

The freezer compartment 40 may be maintained at about −20° C. and keep food in a frozen state. The fresh food compartment 50 may be maintained at a temperature between 0° C. and 5° C. and keep food in a cooled sated. The freezer compartment 40 and the fresh food compartment 50 may be provided with an open front to allow food to be stored and retrieved. The freezer compartment 40 and the fresh food compartment 50 may be provided with shelves 49 and 59 on which food may be placed.

The freezer compartment 40 and the fresh food compartment 50 may be respectively opened and closed by a freezer compartment door 41 and a fresh food compartment door 51 rotatably coupled to the body 10. Door pockets 45 and 55 to easily store food may be respectively provided on the rear surfaces of the freezer compartment door 41 and the fresh food compartment door 51.

Beverage containers and other small-size food may be stored in the door pockets 45 and 55. Dykes 43 and 53 may protrude from the rear surfaces of the doors 41 and 51 to allow installation of the door pockets 45 and 55. The door pockets 45 and 55 may be installed at the dykes 43 and 53.

Specifically, as shown in FIG. 4, a fitting protrusion 46 may be formed at both sides of the door pocket 45, and a fitting groove 44 into which the fitting protrusion 46 is inserted may be formed at the dyke 43. Accordingly, the door pocket 45 may be mounted to the dyke 43 by inserting the fitting protrusion 46 into the fitting groove 44.

The door pocket 45 mounted to the dyke 43 may be easily separated from the dyke 43 by raising the door pocket 45.

The freezer compartment door 41 may be provided with a dispenser 60 to discharge water or ice. A user may obtain water or ice through the dispenser 60 without opening the doors 41 and 51.

The dispenser 60 may include a retrieval space 61 in which a vessel such as a cup is placed to receive water or ice, a switch 62 to operate the dispenser 60, and an ice passage 63 connecting the retrieval space 61 to a crusher 100.

The freezer compartment 40 may be provided with an icemaker 70 to produce ice, and an ice bucket 90 in which ice produced by the icemaker 70 is stored.

The icemaker 70 may produce ice through cold air in the freezer compartment 40 or a separate cooling member such as a direct cooling-type refrigerant tube. The icemaker 70 may include a water supply tube 75 to supply water, an ice making tray 71 (FIG. 7) provided with an ice making groove 71*a* (FIG. 7) having an approximately semi-circular cross section, an ejector 72 (FIG. 7) rotatably provided to separate ice from the ice making tray 71, an ejector motor 73 to drive the ejector 72, a slider 74 (FIG. 7) inclinedly disposed to guide ice separated through the ejector 72 to the ice bucket 90.

The ice bucket 90 may be provided with a transport unit 92 to transport the stored ice toward the dispenser 60 of the door 41. The transport unit 92 may include a spiral auger 93 rotatable about a rotation axis and a transport motor 94 to generate driving force to rotate the auger 93.

When the auger 93 is rotated by operation of the transport motor 94, the ice stored in the ice bucket 90 may be subjected to and transported by the pressure applied by the auger 93. The front bottom surface of the ice bucket 90 may be provided with an outlet 91 through which the ice transported by the transport unit 92 is discharged outside.

The outlet 91 of the ice bucket 90 is arranged so as to be positioned over an inlet 111 (FIG. 3) of the crusher 100 when the freezer compartment door 41 is closed. Accordingly, the ice discharged out of the ice bucket 90 through the outlet 91 of the ice bucket 90 may be guided into the crusher 100 through the inlet 111 of the crusher 100.

The crusher 100 is a device that crushes the ice transported from the ice bucket 90 into small pieces. The ice produced by the icemaker 70 has an approximately semi-circular shape according to the shape of the ice making groove 71*a* (FIG. 7) and a relatively large size. When the ice produced by the icemaker 70 is defined as non-crushed ice, the crusher 100 crushes the non-crushed ice and produces small ice fragments having a relatively small size.

The crusher 100 may selectively crush the ice as opposed to crushing all non-crushed ice into small fragments. That is, the user may be allowed to select whether to crush the non-crushed ice.

According to this embodiment, the crusher 100 is arranged on the rear surface of the freezer compartment door 41, while the icemaker 70 and the ice bucket 90 are provided in the freezer compartment 40. Specifically, the crusher 100 is positioned over the dispenser 60 of the freezer compartment door 41.

As best shown in FIG. 4, a fitting protrusion 46 to be inserted into the fitting groove 44 of the dyke 43 may be provided at both sides of the crusher 100. Accordingly, similar to the door pocket 45, the crusher 100 may be mounted to the dyke 43 on the rear surface of the door 41.

When necessary, the crusher 100 may be separated from the dyke 43 of the door 41. That is, the crusher 100 may be freely mounted to and separated from the dyke 43 of the door 41.

As described above, the crusher 100 according to this embodiment may be independently provided separately from the ice bucket 90 and freely mounted to and separated from the rear surface of the door 41. The crusher 100 is arranged at a position where ice discharged from the ice bucket 90 may move into the crusher 100 when the door 41 is closed.

Accordingly, the ice bucket 90 may be slimmer than in conventional cases. In addition, since the icemaker 70 and the ice bucket 90 are provided in the freezer compartment 40, and the crusher 100 is provided to the rear surface of the door 41, space utilization and usability of the freezer compartment 40 and the rear surface of the door 41 may be enhanced.

That is, a conventional ice bucket having a crusher 100 integrated therewith has a large size compared to the embodiment of the present disclosure. Accordingly, in the case that the ice bucket is disposed in the freezer compartment 40, the space on the rear surface of the door 41 may be not be closely packed, but the space of the freezer compartment 40 may be excessively packed. On the other hand, in the case that the ice bucket is disposed on the rear surface of the door 41, the space of the freezer compartment 40 may not be closely packed, but the space on the rear surface of the door 41 may be excessively packed.

According to this embodiment of the present disclosure, however, the ice bucket 90 is slimmer than in conventional cases. In addition, since the ice bucket 90 is provided in the freezer compartment 40, and the crusher 100 is arranged on the rear surface of the door 41, the freezer compartment 40 and the door 41 are both provided with proper free space. Accordingly, this embodiment may enhance special utilization and usability may be enhanced.

Details of the crusher 100 as described above will be discussed later.

The cold air supply unit to provide cold air to the freezer compartment 40 and the fresh food compartment 50 may include a compressor 12, a condenser (not shown), an expansion valve (not shown), and an evaporator 13. The compressor 12 may be disposed in a machine room 14 provided at a lower portion of the body 10 to be partitioned from the storage compartments 40 and 50.

Figure 5:
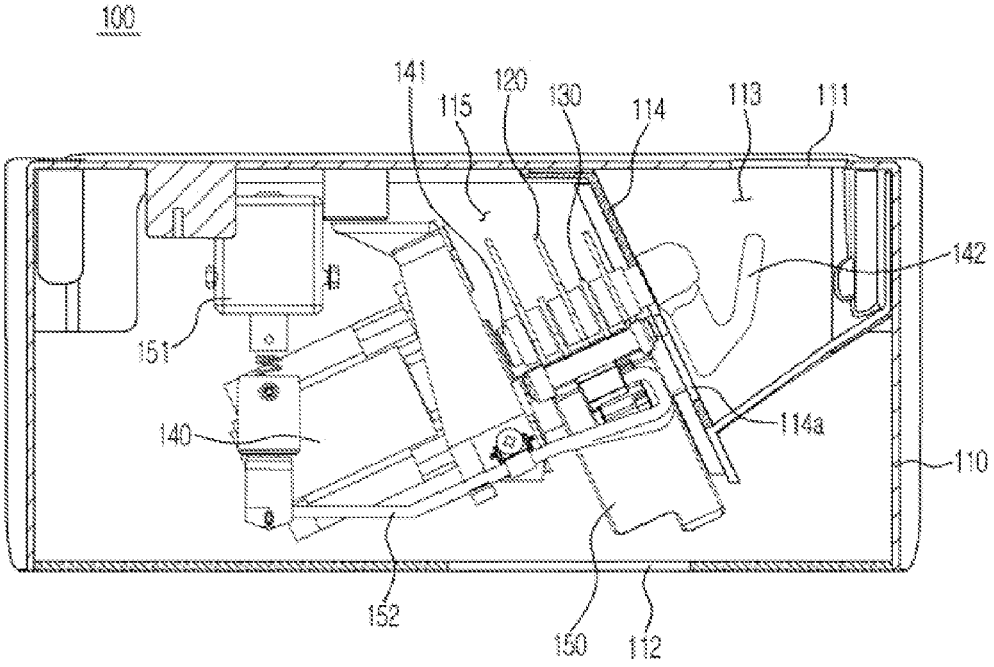
FIG. 5 is a lateral cross-sectional view schematically illustrating the crusher of the refrigerator of FIG. 1.
Figure 6:
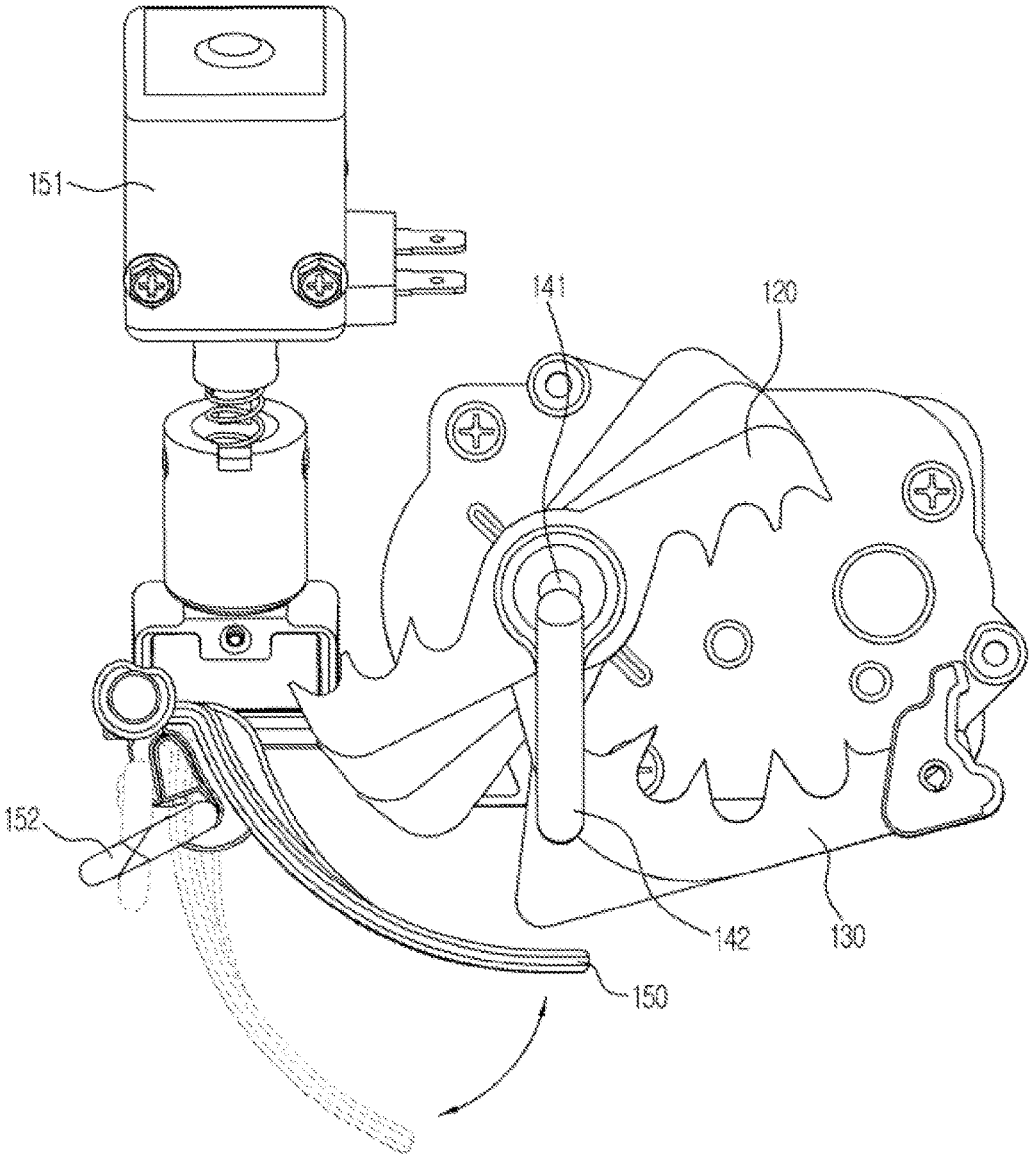
FIG. 6 is a front view illustrating the crusher of the refrigerator of FIG. 1.

FIG. 5 is a lateral cross-sectional view schematically illustrating the crusher of the refrigerator of FIG. 1, and FIG. 6 is a front view illustrating the crusher of the refrigerator of FIG. 1.

Referring to FIGS. 5 and 6, the crusher 100 may included a case 110, an inlet 111 through which ice is introduced into the case 110, an outlet 112 through which ice is discharged from the case 110, a rotating blade 120 rotatably provided in the case 110, a fixed blade 130 fixed to the case 110, a crushing motor 140 to generate driving force to rotate the rotating blade 120, an opening/closing member 150 to select whether to crush ice by opening and closing the outlet, a solenoid unit 151 to generate driving force to drive the opening/closing member 150, and a connection member 152 to connect the opening/closing member 150 to the solenoid unit 151 to transmit the driving force of the solenoid unit 151 to the opening/closing member 150.

The inner space of the case 110 may be partitioned into a storage space 113 in which ice is stored and a crushing space 115 in which the ice is crushed by a partition wall 114. The storage space 113 is connected to the inlet 111, and the crushing space 115 is connected to the outlet 112. A communication hole 114*a* allowing the storage space 113 to communicate with the crushing space 115 is formed in the partition wall 114.

The crusher 100 may further include a stirrer 142 rotatably disposed in the storage space 113 to stir ice. The stirrer 142 may be connected to the shaft 141 of the crushing motor 140 to receive driving force from the crushing motor 140.

When the crushing motor 140 is driven, the stirrer 142 rotates, and the pieces of ice stored in the storage space 113 may pass through the communication hole 114*a* and move to the crushing space 115 one by one.

When an ice crushing mode is selected, the opening/closing member 150 moves upward to support ice in the crushing space 115, as indicated by a solid line in FIG. 6. Then, the ice may be crushed in between the rotating blade 120 and the fixed blade 130 according to rotation of the rotating blade 120. The ice fragments produced through crushing may be discharged toward the dispenser 60 through the outlet 112 of the crusher 100.

When a non-crushing mode is selected, the opening/closing member 150 moves downward, as indicated by a dotted line in FIG. 6. Thereby, the ice of the crushing space 115 is not supported by the opening/closing member 150, may thus be immediately discharged to the outlet 112 positioned therebelow. Accordingly, non-crushed ice may be discharged toward the dispenser 60 through the outlet 112 of the crusher 100.

Figure 7:
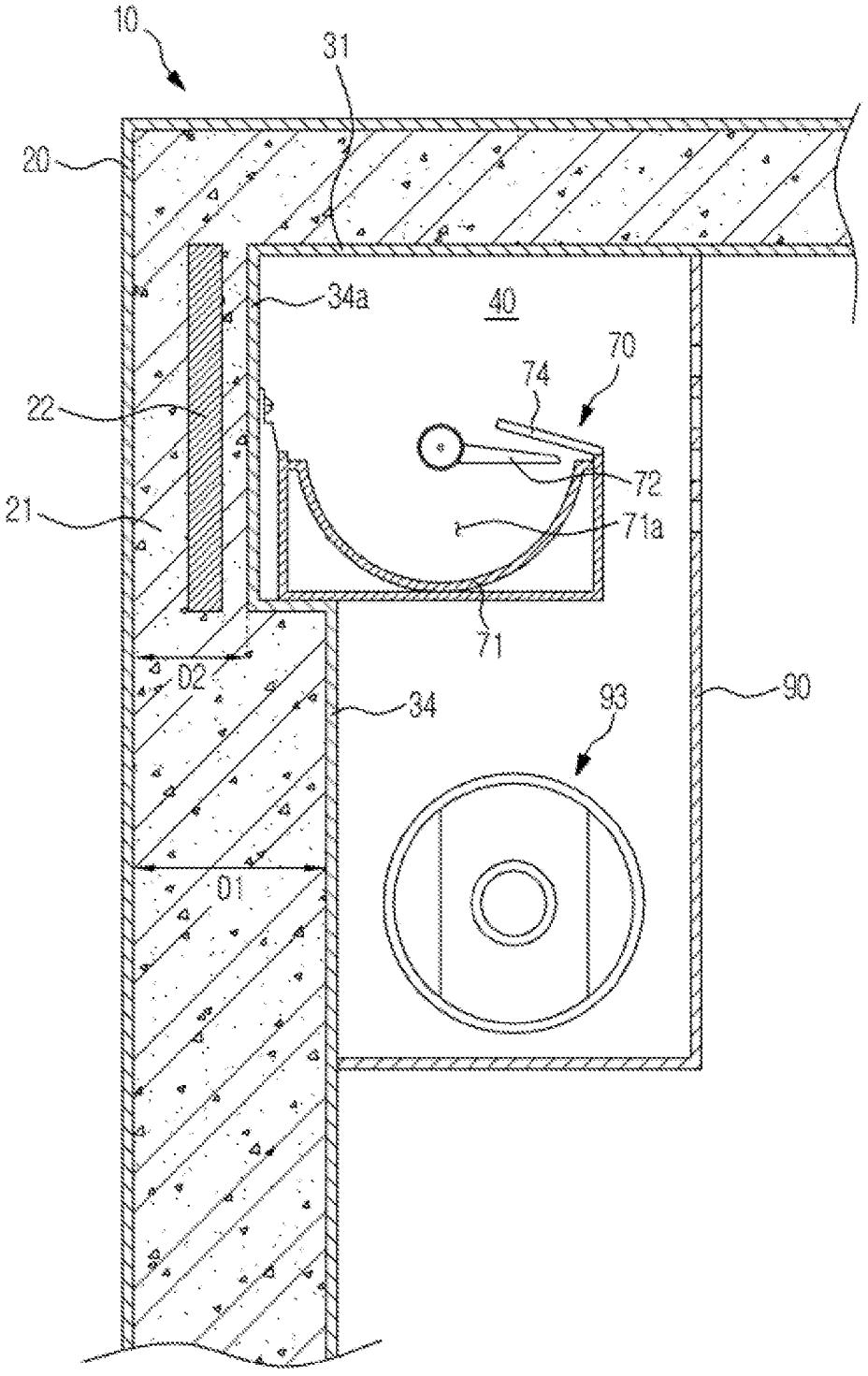
FIG. 7 is a cross-sectional view illustrating an icemaker of the refrigerator of FIG. 1, which is installed such that a part of the icemaker is accommodated in an accommodation portion of an inner case.

FIG. 7 is a cross-sectional view illustrating an icemaker of the refrigerator of FIG. 1, which is installed such that a part of the icemaker is accommodated in an accommodation portion of an inner case.

Referring to FIG. 7, the sidewall 34 of the inner case of the refrigerator according to the illustrated embodiment may further include an accommodation portion 34*a* to accommodate at least one portion of the icemaker 70. At least one portion of the icemaker 70 may be accommodated in the accommodation portion 34*a*.

Thereby, the distance by which the icemaker 70 protrudes inwardly from the sidewall 34 may be decreased and accordingly the space of the freezer compartment 40 may increase.

In addition, the ice bucket 90 to store ice discharged from the icemaker 70 may be designed to have a slimmer width.

The accommodation portion 34*a* may be a groove recessed from the sidewall 34 of the inner case toward the insulation member 21 and the outer case 20. Accordingly, in a section in which the accommodation portion 34*a* is formed, the distance between the sidewall 34 of the inner case and the outer case 20 may be narrower than in the other section.

That is, in the section in which the accommodation portion 34*a* is formed, the distance D2 between the sidewall 34 of the inner case and the outer case 20 may be less than the distance D1 between the sidewall 34 of the inner case and the outer case 20 in a section in which the accommodation portion 34*a* is not formed.

Therefore, to sufficiently insulate the freezer compartment 40, a vacuum insulation member 22 having a better insulation effect than the urethane foam insulation member 21 may be provided in the space between the sidewall 34 of the inner case and the outer case 20 in the section in which the accommodation portion 34*a* is formed.

Figure 8:
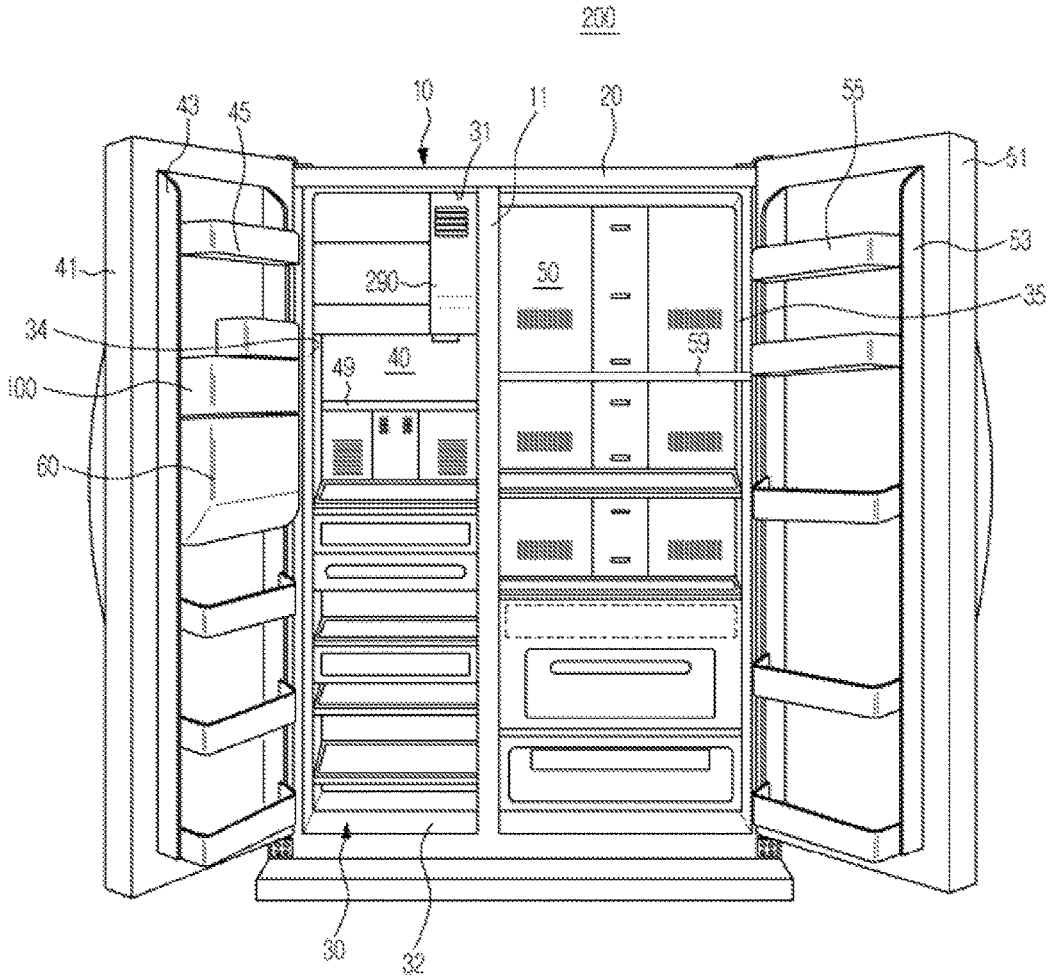
FIG. 8 is a view showing the entire external appearance of a refrigerator according to another embodiment of the present disclosure.

FIG. 8 is a view showing the entire external appearance of a refrigerator according to another embodiment of the present disclosure.

Hereinafter, a refrigerator according to another embodiment will be described with reference to FIG. 8. Constituents identical to those of the previous embodiment will be assigned to the same reference numerals as in the previous embodiment and a description thereof may be omitted.

In a refrigerator 200 of this embodiment, the positions of an icemaker and an ice bucket 290 differ from the positions of corresponding constituents of the refrigerator of the previous embodiment. That is, the icemaker and the ice bucket 290 are arranged to closely contact the intermediate wall 11 of the inner case 30 rather than the sidewall 34 of the inner case 30.

The inlet of the crusher 100 needs to be located under the outlet of the ice bucket 290 such that the ice discharged from the ice bucket 290 moves into the crusher 100.

Although not shown in FIG. 8, the intermediate wall 11 may be provided with an accommodation portion in which at least one portion of the icemaker is accommodated. The icemaker may be disposed such that at least one portion thereof is accommodated in the accommodation portion. In the section in which the accommodation portion is provided, a vacuum insulation member may be included in the interior of the intermediate wall 11.

As is apparent from the above description, according to embodiments of the present disclosure, a crusher is provided separately from an ice bucket. Accordingly, the ice bucket may have a slimmer width.

In addition, by separately disposing the crusher and the ice bucket, space utilization and usability of the storage compartments and the rear surface of the doors may be enhanced.

In addition, the crusher is detachably provided to the rear surface of the door. Accordingly, replacement and repair of the crusher may be facilitated.

Although a few embodiments of the present disclosure have been shown and described, it would be appreciated by those skilled in the art that changes may be made in these embodiments without departing from the principles and spirit of the invention, the scope of which is defined in the claims and their equivalents.

What is claimed is:

1. A refrigerator comprising:

a body;

a storage compartment provided in the body;

a door rotatably coupled to the body to open and close the storage compartment;

a dispenser provided to the door to allow water or ice in the storage compartment to be supplied to an exterior of the storage compartment without opening the door;

an icemaker provided in the storage compartment to produce ice;

an ice bucket provided in the storage compartment to store ice produced by the icemaker;

a transport unit provided to the ice bucket to transport the ice stored in the ice bucket toward the dispenser; and a crusher arranged to receive ice from the transport unit, to crush the received ice, and to supply the crushed ice to the dispenser, the crusher being provided separately from the ice bucket and the transport unit;

a dyke protruding from the rear surface of the door and being provided with a fitting groove; and a door pocket, wherein the crusher is provided with a fitting protrusion such that the crusher is detachably mountable to the dyke on the rear surface of the door separately from the ice bucket by fitting the fitting protrusion into the fitting groove.

2. The refrigerator according to claim 1, wherein the dyke is provided with a fitting groove, and the crusher is provided with a fitting protrusion, wherein the crusher is mounted to the dyke by fitting the fitting protrusion into the fitting groove.

3. The refrigerator according to claim 1, wherein the crusher comprises a crushing motor to provide driving force to rotate a rotating blade of the crusher, the crushing motor being provided separately from a transport motor to drive the transport unit.

4. The refrigerator according to claim 1, wherein the crusher comprises a case, a rotating blade rotatably provided in the case, a fixed blade fixed to the case, a crushing motor to drive the rotating blade, an inlet allowing the ice to be introduced into the case therethrough, an outlet allowing the ice to be discharged from the case, an opening/closing member to open and close the outlet, and a solenoid unit to drive the opening/closing member.

5. The refrigerator according to claim 4, wherein the crusher further comprises a storage space to store the ice introduced through the inlet, a crushing space to crush the ice, a partition wall to partition the storage space and the crushing space from each other, a communication hole formed in the partition wall to allow the storage space and the crushing space to communicate with each other, and a stirrer to stir the ice in the storage space such that the ice in the storage space moves to the crushing space.

6. The refrigerator according to claim 4, wherein, when the door is closed, the inlet of the crusher is positioned directly under an outlet of the ice bucket such that the ice bucket communicates with the crusher.

7. The refrigerator according to claim 1, wherein the body comprises an outer case, an inner case provided inside the outer case, and an insulation member provided between the outer case and the inner case, wherein the inner case is provided with an accommodation portion recessed toward the insulation member to accommodate at least one portion of the icemaker.

8. The refrigerator according to claim 7, wherein a vacuum insulation member is provided between the outer case and the accommodation portion of the inner case.

9. The refrigerator according to claim 7, wherein the inner case comprises a top wall, a bottom wall, a rear wall, a plurality of sidewalls, and an intermediate wall, wherein the accommodation portion is formed at one of the sidewalls and the intermediate wall.

10. A refrigerator comprising:

a body comprising an outer case, an inner case provided inside the outer case, and an insulation member provided between the outer case and the inner case, the inner case comprising a top wall, a bottom wall, a rear wall, a plurality of sidewalls, and an intermediate wall;

a storage compartment provided in the body;

a door rotatably coupled to the body to open and close the storage compartment;

a dispenser provided to the door to allow water or ice in the storage compartment to be supplied to an exterior of the storage compartment without opening the door;

an icemaker provided in the storage compartment to produce ice;

an ice bucket provided in the storage compartment to store ice produced by the icemaker; and a transport unit provided to the ice bucket to transport the ice stored in the ice bucket toward the dispenser, wherein one of the sidewalls of the inner case includes an accommodation portion recessed toward the insulation member to accommodate at least one portion of the icemaker.

11. The refrigerator according to claim 10, wherein a distance between the inner case and the outer case is shorter in a section having the accommodation portion than in the other section.

12. The refrigerator according to claim 10, wherein a vacuum insulation member is provided between the outer case and the accommodation portion of the inner case.

13. The refrigerator according to claim 10, wherein the accommodation portion is further formed at the intermediate wall.

* * * * *